United States Patent [19]

Lee et al.

[11] Patent Number: 4,976,215

[45] Date of Patent: Dec. 11, 1990

[54] DOOR ACTIVITY MONITORING APPARATUS

[76] Inventors: William C. Lee; Irene H. Lee, both of 1001 Carpenters Way, #B-302, Lakeland, Fla. 33809

[21] Appl. No.: 335,303

[22] Filed: Apr. 10, 1989

[51] Int. Cl.[5] ..... G08B 13/08

[52] U.S. Cl. ..... 116/215; 116/204

[58] Field of Search ..... 116/85, 86, 100, 204, 116/203, 215; 232/35, 37

[56] References Cited

U.S. PATENT DOCUMENTS

| | | | |
|---|---|---|---|
| 823,782 | 6/1906 | Holden | 116/215 |
| 2,681,762 | 6/1954 | Long et al. | 232/35 |
| 2,780,198 | 2/1957 | Low | 116/215 |
| 3,080,107 | 3/1963 | Lindahl | 232/35 |
| 4,756,472 | 7/1988 | Hammons | 232/35 |

FOREIGN PATENT DOCUMENTS

| | | | |
|---|---|---|---|
| 381625 | 10/1932 | United Kingdom | 116/100 |
| 1407815 | 9/1975 | United Kingdom | 116/204 |
| 2187875 | 9/1987 | United Kingdom | 40/530 |

*Primary Examiner*—William A. Cuchlinski, Jr.
*Assistant Examiner*—W. Morris Worth

[57] ABSTRACT

A door activity monitoring apparatus (10) including a pivoted signal unit (11) that is mounted on a door jamb (100) and has a magnetically attractive indicator member (14) which cooperates with a magnetic keeper unit (12) that is secured to the door (103) to provide a visual signal indicative that the door (103) has been moved relative to the door jamb (100).

3 Claims, 1 Drawing Sheet

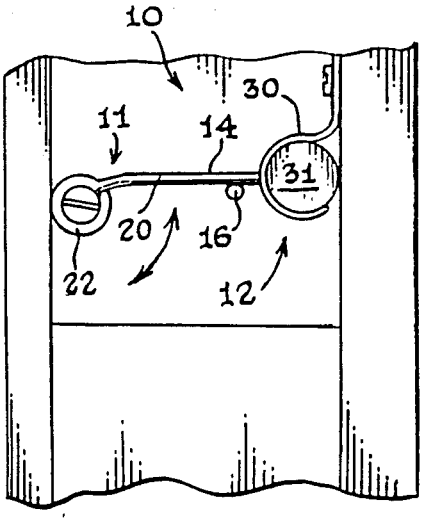
FIG. 1.
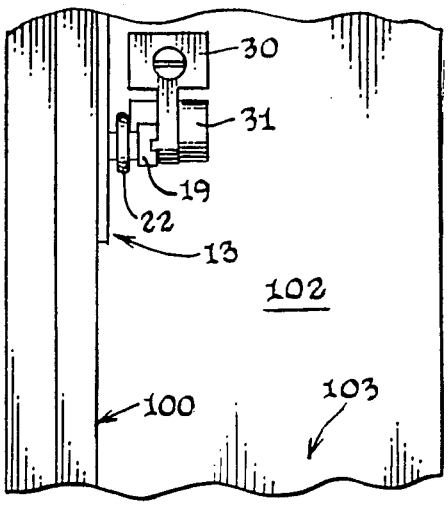
FIG. 2.
FIG. 3.
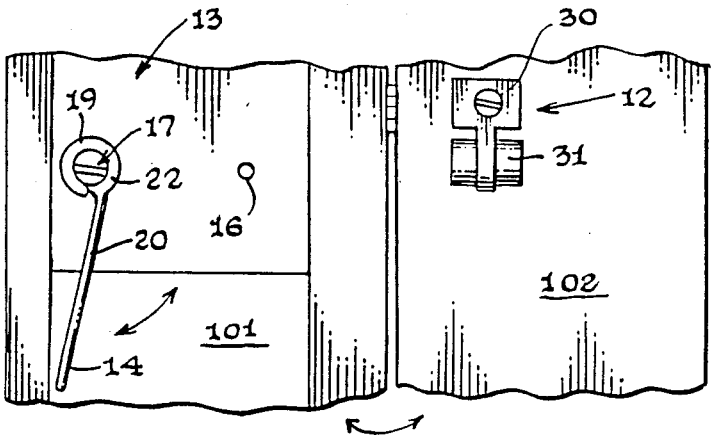
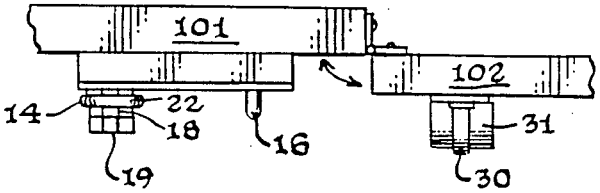
FIG. 4.

DOOR ACTIVITY MONITORING APPARATUS

TECHNICAL FIELD

This invention relates generally to the field of signaling devices, and more particularly to a device that monitors whether or not a door has been opened since the device was last set in the quiescent mode.

BACKGROUND OF THE INVENTION

This invention was the subject matter of Document Disclosure Program Registration No. 184927, which was filed in the U.S. Patent and Trademark Office on Jan. 22, 1988.

One of the most pressing problems associated with nursing home day to day operations is the time and effort expended by the nursing home staff in checking on the activity patterns of the residents of the home.

When serving the needs of aged and infirm residents it is imperative that the staff be aware of whether or not an individual has left the confines of his room during a given period of time. On those occasions when there has been an extended or unusual period of inactivity on the occupant of a room; it is both advisable and often times necessary and crucial that the staff be aware of this situation, so that they may inquire as to the condition of the resident's health or state of mind.

All too often a resident's inability or failure to open the door of his room is indicative of a serious or life threatening situation; and the staff must be constantly aware of whether or not a resident's door has been opened, without the need of checking every room on a continual basis to verify the presence, absence, or condition of the occupant.

As can be seen by reference to the following U.S. Pat. Nos.: 4,040,381, 4,414,912; 4,067,289; and 3,516,036 the prior art is replete with myriad and diverse audio and visual indicators that signal whether or not a door has been opened. However, these prior art signaling devices are employed for a variety of uses not necessarily restricted simply to the lack of activity of a room occupant. In addition, most of the aforementioned signaling devices would be ill-suited to the particular area of concern of the present invention, with the possible exception of the Keogh, Sr. et al. patent which operates on the same basic principles, yet a different orientation than that employed in the construction and operation of this invention.

Furthermore, all of the above cited patents are uniformly deficient for the door monitoring purposes set forth herein; in that, these devices do not allow the signaling mechanism to be present regardless of whether the door is open or closed; wherein, the closure of the door operatively engages the pre-set mechanism into a signal engaged mode, whereby the subsequent opening of the door will automatically allow the signal element to drop by gravity into the door opened signal mode.

SUMMARY OF THE INVENTION

Briefly stated, the door activity monitoring apparatus that forms the basis of the present invention comprises in general: a magnetic keeper unit and a pivoted signal unit, which are operatively associated with a door and door jamb respectively, to indicate whether or not the door has been opened relative to the door jamb during a given period of time.

The magnetic keeper unit comprises a ferro-magnetic member that is secured to a bracket member that is adapted to be mounted to the door at a desired location in close proximity to the hinged signal unit.

The pivoted signal unit comprises: a stationary mounting plate member having an outwardly projecting support shelf; and, an indicator member pivotally secured to the mounting plate and fabricated from magnetically attractive material. In addition, the pivotal arrangement between the mounting plate member and the indicator member is such that the indicator member is laterally translatable on the pivot element, so that the magnetic attraction between the magnet member and the indicator member will dislodge the indicator member from its supported relationship with the shelf on the mounting plate member.

Once the indicator becomes disengaged with the support shelf due to the movement of the door relative to the door jamb, the indicator member will drop by gravity to a vertically downwardly depending position to indicate that the occupant has at least opened the door if not left his room.

BRIEF DESCRIPTION OF THE DRAWINGS

These and other objects, advantages, and novel features of the invention will become apparent from the detailed description of the best mode for carrying out the preferred description of the best mode for carrying out the preferred embodiment of the invention which follows; particularly when considered in conjunction with the accompanying drawings, wherein:

FIG. 1 is a perspective view of the door activity monitoring apparatus deployed on a door assembly;

FIG. 2 is an isolated top plan view of the hinged signal unit;

FIG. 3 is a front plan view of the apparatus; and,

FIG. 4 is a top plan view of the apparatus.

BEST MODE FOR CARRYING OUT THE INVENTION

As can be seen by reference to the drawings and in particular to FIG. 1, the door activity monitoring apparatus that forms the basis of the present invention is designated generally by the reference numeral (10). The door activity monitoring apparatus (10) comprises in general: a pivoted signal unit (11); and, a magnetic keeper unit (12). These units will now be described in seriatim fashion.

As can best be seen by reference to FIGS. 2 and 3, the pivoted signal unit (11) comprises a mounting plate member (13) pivotally secured to an indicator member (14). The mounting plate member (13) comprises an elongated generally thin flat plate (15) adapted to be secured to the external surface (101) of a door jamb (100) at a predetermined location, in close proximity to the hinged side (102) of the door (103) that is opposite from the door handle (104). In addition, the mounting plate member (13) is equipped with a support post (16), which projects outwardly a small distance from the face of the plate (15); and, which is disposed towards the end of the plate (15) which is closest to the side (102) of the door (103).

Still referring to FIGS. 2 and 3, it can be seen that the mounting plate member (13) is further provided with a relatively elongated pivot member (17); which is spaced from the support post (16); and, which comprises an elongated pivot rod (18) having an enlarged end cap (19) formed on its outboard end.

In addition, the indicator member (14) comprises an elongated indicator arm (20) fabricated from a magnetically attractive material and provided with a looped portion (22) disposed proximate one end, and dimensioned to loosely receive the pivot rod (18) yet prevent the passage of the enlarged end cap (19). It should also be noted that the length of the indicator arm (20) is slightly greater than the length of the mounting plate member (13); and, the width of the indicator arm (20) is less than the width of the support post (16) on the mounting plate member (13).

Furthermore, the length of the elongated pivot rod (18) is significantly longer than the combined width of the support post (16) and the width of the indicator arm (20); whereby, the indicator arm (20) may be laterally translatable relative to the elongated pivot rod (18) such that the indicator arm (20) is no longer supported by the post (16) and may fall by gravity to the position depicted by dashed lines in FIG. 3.

As shown in FIGS. 2 and 3, it can be seen that the magnetic keeper unit (12) comprises a bracket member (30) operatively secured to a ferro-magnetic member (31); wherein, the bracket member (30) is adapted to be secured to the door (103), such that the magnetic member (31) is disposed in close proximity to the arc of rotation of the indicator arm (20) about the pivot rod (18).

Once the magnetic member (31) comes into close proximity with the indicator arm (20) the magnetic attraction between the magnet (31) and the indicator arm (20) will be sufficient to laterally translate the indicator arm (20) relative to the support post (16) and the pivot rod (18); such that when the magnetic field attraction is broken by the movement of the door (103) away from the door jamb (100) the indicator arm (20) will fall by gravity to the position indicated in FIG. 3.

It should also be appreciated at this juncture that the pivoted signal unit (11) may be pre-set by the occupant prior to closing the door (103) such that once the door (103) has been closed the magnetic attraction between the indicator arm (20) and the magnet (31) will arm the monitoring apparatus. In addition, should the room occupant neglect or forget to pre-position the pivoted signal unit (11); it is a simple matter for a staff member to rotate the indicator arm (20) in either a clockwise or counterclockwise direction to actively engage the signaling unit (11) relative to the magnetic keeper unit (12).

Having thereby described the subject matter of this invention, it should be apparent that many substitutions, modifications, and variations of the invention are possible in light of the above teachings. It is therefore to be understood that the invention as taught and described herein is only to be limited to the extent of the breadth and scope of the appended claims.

We claim:

1. A door activity monitoring apparatus in combination with a door assembly including a door jamb and a door having a door handle wherein the monitoring apparatus comprises:

a pivoted signal unit having means for attaching the signal unit to the door jamb proximate the hinged portion of the door that is furthest from the door handle; wherein, the pivoted signal unit includes: an elongated indicator member fabricated from magnetically attractive material pivotally secured at one end to a mounting plate member.

a support post projecting outwardly from the mounting plate member for temporary support of a second end of the indicator member; a pivot member including an elongated pivot rod and an enlarged cap; wherein, the pivot rod of the pivot member is operatively attached to the mounting plate member and the indicator member; and wherein, said one end of the indicator member is dimensioned to be loosely received on the elongated pivot rod intermediate the mounting plate member and the enlarged cap; such that the indicator member is laterally translatable relative to the mounting plate member and support post; and, a stationary magnetic keeper unit operatively attached to the door proximate the location of the pivoted signal unit; wherein, the magnet keeper unit includes a ferro-magnetic member that will magnetically attract and laterally displace the indicator member relative to the mounting plate member and support post while the door is closed relative to the door jamb such that the opening of the door relative to the door jamb will allow the indicator to drop by gravity into a door activity signal position.

2. The apparatus as in claim 1 wherein said one end of the indicator member is provided with a looped portion that is dimensioned to loosely receive the elongated pivot rod of the pivot member; and, which is also dimensioned to prevent the passage of the enlarged end cap of the pivot member.

3. The apparatus as in claim 2 wherein the length of the elongated pivot rod is significantly longer than the combined widths of the indicator member and the support post.

* * * * *